US007299573B1

(12) United States Patent
Kuncken

(10) Patent No.: US 7,299,573 B1
(45) Date of Patent: Nov. 27, 2007

(54) REVERSIBLE, MAGNETIC IRONING PAD ASSEMBLY

(76) Inventor: Karen Kuncken, 114 Cape St., Charleston, SC (US) 29492

( * ) Notice: Subject to any disclaimer, the term of this patent is extended or adjusted under 35 U.S.C. 154(b) by 0 days.

(21) Appl. No.: 11/728,062

(22) Filed: Mar. 23, 2007

(51) Int. Cl.
*D06F 83/00* (2006.01)
*D06F 81/00* (2006.01)

(52) U.S. Cl. ..... 38/140

(58) Field of Classification Search ..... 38/103, 38/140, 66, 137; 16/431; 2/158; 40/711
See application file for complete search history.

(56) References Cited

U.S. PATENT DOCUMENTS 2,641,793 A * 6/1953 Wilm ..... 16/435
2,905,946 A * 9/1959 Goldsmith ..... 2/158
3,263,736 A 8/1966 Macomson
3,295,577 A 1/1967 Danielson
3,324,584 A 6/1967 Adiletta et al.
3,911,603 A 10/1975 Lehrman
3,965,599 A * 6/1976 Ebner ..... 40/711
4,043,062 A 8/1977 Lehrman
4,232,460 A 11/1980 Krulwich
4,360,984 A 11/1982 Ruttenberg
4,616,434 A 10/1986 Riba et al.
4,621,003 A 11/1986 O'Kane
4,647,487 A 3/1987 O'Neill
4,885,195 A 12/1989 Change, III
D306,508 S 3/1990 Stringer
5,036,777 A 8/1991 Barton
5,129,695 A * 7/1992 Norman, II ..... 293/128
5,272,825 A 12/1993 Simpson
5,398,437 A * 3/1995 Bump et al. ..... 40/582
D369,889 S 5/1996 Buckner
5,706,593 A 1/1998 Allard et al.
6,302,095 B1 10/2001 Tolley et al.
6,536,144 B2 3/2003 Steidle
6,655,055 B2 * 12/2003 Loger et al. ..... 38/137
6,769,205 B1 8/2004 Steidle
6,793,991 B2 9/2004 Thuma et al.
7,131,223 B2 11/2006 Krotts et al.
2004/0216337 A1 11/2004 Harrison et al.
2006/0117614 A1 6/2006 Lee et al.
2006/0117615 A1 6/2006 Wendelken et al.
2006/0143954 A1 7/2006 Cevenini et al.
2006/0213093 A1 9/2006 Krotts et al.

* cited by examiner

*Primary Examiner*—Ismael Izaguirre
(74) *Attorney, Agent, or Firm*—Harleston Law Firm, LLC

(57) ABSTRACT

A reversible, magnetic ironing surface includes: (a) a generally rectangular-shaped, flexible pad portion including a first, quilted, heat resistant layer; and a second, opposite, generally smooth, heat resistant layer on an opposite side of the pad portion; and (b) at least one magnet in each corner section of the pad portion; wherein the pad assembly has an expanded, open position for use and a compact, bundled position for transport or storage, and in the expanded position, the pad portion is reversible for use on either side; and the first or second layer includes a metal.

20 Claims, 5 Drawing Sheets

REVERSIBLE, MAGNETIC IRONING PAD ASSEMBLY

BACKGROUND OF THE INVENTION

1. Technical Field

The present invention relates to a reversible, flexible, magnetic ironing pad assembly with an expanded position for use on either side of the pad and a compact, bundled position for transport or storage, more particularly an ironing pad assembly with magnets for placement and use on a substantially horizontal and planar surface that is preferably ferromagnetic, such as a top of a washing machine, clothes dryer, desk, etc.

2. Background Information

Although most household devices have come a long way in the past few decades, the majority of households have one household aid that seems to have stopped in time: the ironing board. Ironing boards require space and set up time and they often rock during use. There is a need in today's marketplace for a convenient, stable, space-saving ironing surface that provides ready access without requiring assembly, especially since many fabrics today are blends that only require touch ups with an iron.

The present invention is an easy to use, inexpensive, flexible ironing pad assembly that is generally rectangular in shape. The reversible ironing pad assembly is suitable for at home use, even in the confined spaces found in many apartments or senior citizen facilities. It requires a negligible amount of set up time and it can be left permanently atop a major appliance or other substantially horizontal and planar surface for quick daily use, or bundled for transport or storage, as needed.

The ironing pad assembly includes magnets in its corner areas for maintaining the ironing pad assembly on a substantially planar and horizontal surface that is ferromagnetic, such as the top of a washing machine, clothes dryer, desk, or other support surface suitable for ironing. The magnets adhere to the sides of the appliance or other support surface. The ironing pad assembly can be attached to or removed from the ferromagnetic surface with a single arm motion. The ironing pad assembly of the present invention is also usable on a non-ferromagnetic surface. After using it to iron clothing and other items that require ironing at home or while traveling, the pad assembly may remain in place, since it takes up little space. Alternatively, the pad assembly can be bundled into the compact, bundled position for storage or transport.

BRIEF SUMMARY OF THE INVENTION

The present invention is a lightweight, reversible ironing pad assembly for performing ironing, comprising:

(a) a generally rectangular-shaped, flexible pad portion comprising a first, quilted, heat resistant layer; and a second, opposite, generally smooth, heat resistant layer on an opposite side of the pad portion; and (b) at least one magnet in each corner section of the pad portion;

wherein the pad assembly has an expanded, open position for use and a compact, bundled position for transport or storage, and in the expanded position, the pad portion is reversible for use on either side, depending upon the type of material to be ironed; and wherein the first or second layer comprises a metal.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
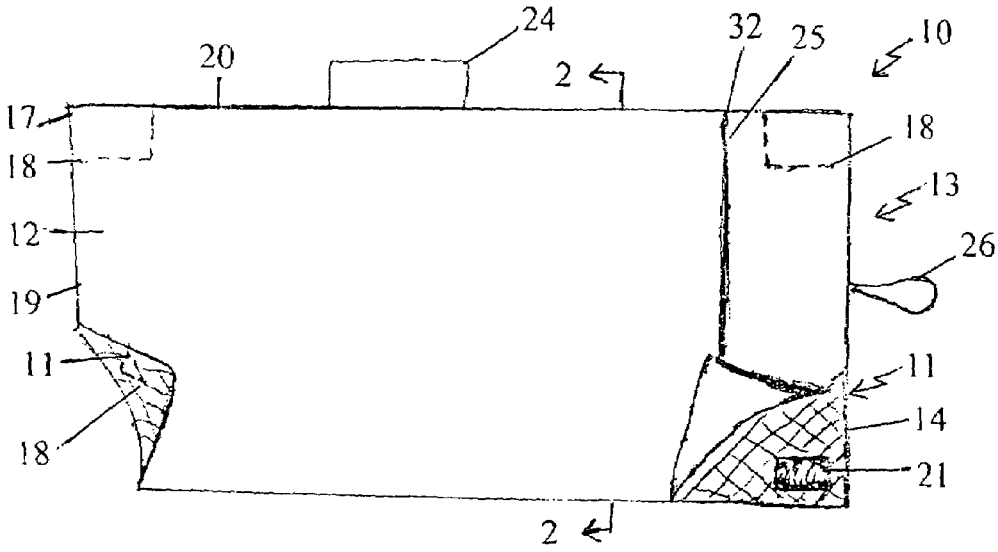
FIG. 1 is a perspective view of an ironing pad assembly according to the present invention.

In the following description, like reference characters designate like or corresponding parts throughout the several views. Also, in the following description, it is to be understood that such terms as "back", "within," and the like are words of convenience and are not to be construed as limiting terms. Referring in more detail to the drawings, the invention will now be described.

Figure 2:
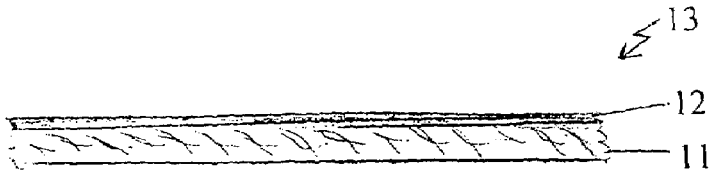
FIG. 2 is a cross-sectional view of a pad portion of the ironing pad assembly of FIG. 1; taken across line 2-2.
Figure 3:
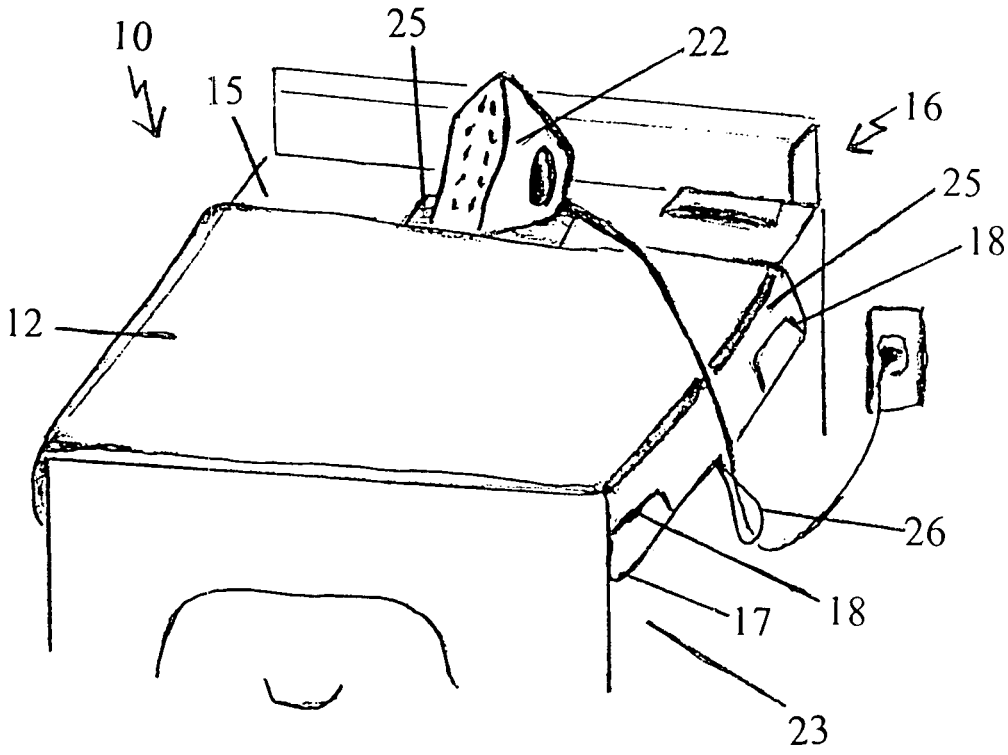
FIG. 3 is a perspective view of an ironing pad assembly according to the present invention, shown in use.
Figure 4:
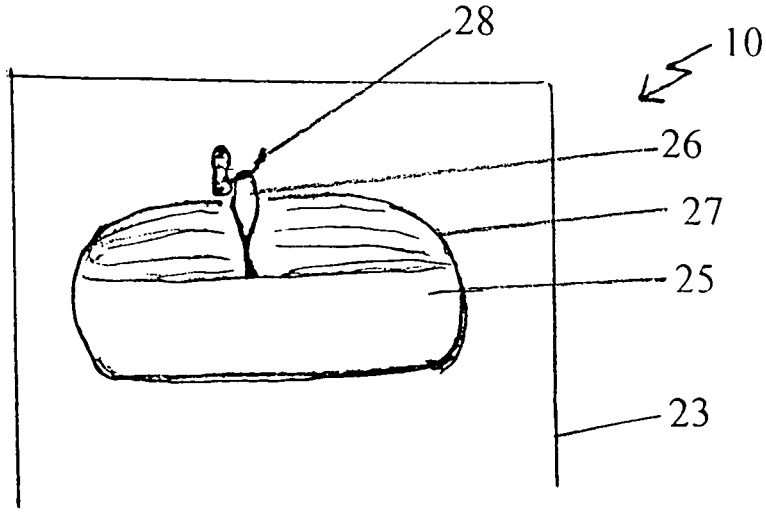
FIG. 4 is a perspective view of an ironing pad assembly according to the present invention, shown in a folded position and hung on a hook.
Figure 5:
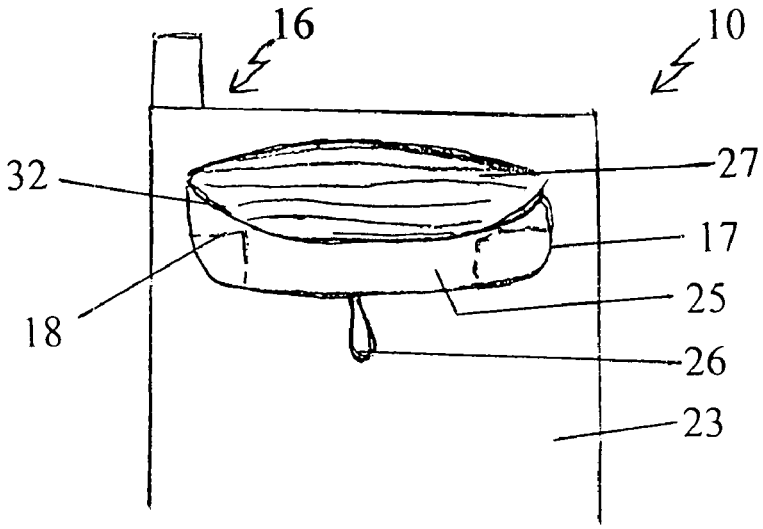
FIG. 5 is a perspective view of an ironing pad assembly according to the present invention, shown in a compact position and magnetically attached to a side of a major appliance.

Turning first to FIGS. 1 through 6, a reversible ironing pad assembly generally referred to herein as 10 includes a generally rectangular-shaped, flexible pad portion 13. As seen in FIGS. 1 and 2, the pad portion 13 includes a heat resistant, quilted, first layer 11 on a first side of the pad assembly 10, and a second, smoother layer 12 on an opposite side of the pad assembly 10, which is also made of any suitable heat resistant material. The pad assembly 10 does not require any middle insulating or other additional, separate, interior layers (such as foam, polyurethane, or padding) between the first and second layers 11, 12. The first and second layers 11, 12 are preferably substantially the same length and width as one another, and made of thin sheets of a material that comprises a metal, such as aluminum. The metal in the layers 11, 12 is preferably aluminum, but not an aluminum foil layer. The pad assembly 10 has an extended position as shown in FIGS. 1 and 3 for use while ironing, and a compact, bundled position as shown in FIGS. 4 and 5 for storage if desired. The pad assembly 10 is flexible enough to be used for ironing and to be repeatedly bundled and unbundled. The ironing pad assembly 10 is intended to obviate the need for a conventional ironing board. The pad assembly 10 provides a stable, semi-permanent ironing surface that is magnetically attachable to a substantially planar surface of a major appliance, desk, etc. The pad portion 13 is reversible for use on either side, depending upon the type of fabric or other material being ironed. The exterior surface of the first, quilted layer 11 is useful for ironing heavier, sturdy fabrics, or the pad assembly 10 can be flipped over and the exterior (exposed) surface of the second, smooth layer 12 used to iron more delicate fabrics. By "smooth" is meant that the exterior surface of the second layer 12 is flat and even so that delicate fabrics will glide across unimpeded.

The first and second layers 11, 12 are preferably made of the same metallic, heat resistant fabric, which resists heat from an iron on its hottest setting, in order to prevent heat penetration and damage to the tabletop or other substantially horizontal and planar surface under the ironing pad assembly. The first and second layers 11, 12 are most preferably made of the same aluminized, heat resistant cotton-containing fabric, with the quilted layer 11 being quilted. For example, the layers can be aluminized cotton that has been coated with aluminum particles during manufacture of the fabric. The surface of the aluminized cotton fabric is smooth enough to iron even delicate fabrics on the second, smooth layer. This fabric is thin and sturdy enough to permit easy ironing on the heat resistant two layer pad assembly. The aluminized cotton fabric is also lightweight, so the pad assembly 10 is easy to handle, bundle, and pack in a suitcase or the like. The first, quilted layer 11 preferably comprises the aluminized cotton exterior with a fabric backing 14 on its interior surface. A cotton or polyester backing 14 is preferred. The quilt layer backing 14 is preferably quilted or otherwise sewn or laminated onto the aluminized cotton exterior. Adhesives are preferably not used herein because of the heat from the iron.

Referring to FIGS. 1 and 2, the first, quilted and second, smooth layers 11, 12 are overlaid on top of one another and secured to one another along their periphery by any suitable means, such as stitching with or without a seam binding. Most preferably, three inside pad seams and end portions of a seam on a fourth side 19 of the pad portion are machine stitched along the periphery of the pad portion with the pad portion 13 inside out. The pad portion 13 is then turned out through the opening in the fourth side 19 and the remainder of the pad seam in the fourth side 19 is sewn. If desired, a product label is stitched into the fourth side seam. The pad seams may be topstitched (most preferably a ¼ inch top seam) to reinforce the periphery of the pad portion and reduce bunching of the pad portion.

The first, quilted layer 11 is quilted in any suitable manner, preferably by stitching substantially parallel rows in two different directions across the material to form diamond shapes in the material, as seen in FIG. 1. The pad assembly 10 is reversible; either side can be used for ironing. The first, quilted layer 11 is for use ironing heavier weight fabrics, such as corduroy, linen, and denim. The quilted layer 11 provides greater surface area and bulk to better distribute the heat from the hot iron required to iron heavier fabrics. Quilting also prevents bunching of the quilted layer backing 14. The opposite, second layer 12, which has a smoother, flatter surface, is useful for ironing lighter weight fabrics, such as silk, chiffon, and cotton blends. The more delicate fabrics glide across the second, smooth layer 12 during the ironing process while the first, quilted layer 11 beneath the second, smooth layer 12 provides extra padding and heat retention.

Referring to FIG. 2, the pad portion 13 is preferably relatively thin and generally uniform throughout the pad portion 13 so as to facilitate the ironing process. The pad portion 13 is preferably between about ½ and about 1½ inches in thickness.

Figure 7:
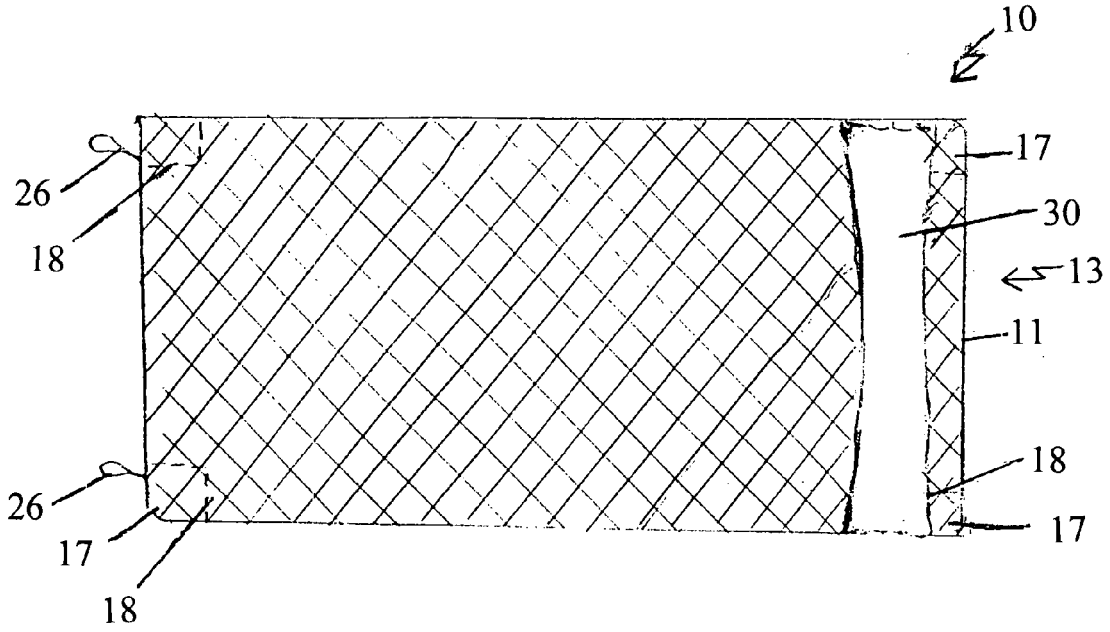
FIG. 7 is a perspective view of an ironing pad assembly according to the present invention, showing a quilted side of a pad portion having two loops and a band.

The four corners of the pad portion 13 may be rounded as shown in FIG. 7, or more sharply angled as shown in FIG. 1. For purposes of illustrating the interior of the pad portion 13, a corner section 17 of the pad portion 13 is shown split open with the second layer 12 flapped back in FIG. 1. For purposes of illustration, a second corner section 17 in FIG. 1 is folded back in order to show the reverse, quilted layer 11 of the pad portion 13.

The pad assembly 10 is adapted to be placed in its extended position on a substantially horizontal and planar support surface 15, such as a top of a major appliance (e.g., washing machine, clothes dryer), desk, table, credenza, cabinet, bureau, countertop, suitcase, etc. To use it, the pad assembly 10 is simply placed on top of the clothes dryer 16, as shown in FIG. 3, or other support surface 15. The support surface 15 is preferably firm enough to iron on and ferromagnetic so that it attracts the magnets 21 in the pad assembly 10.

The pad portion 13 is preferably much shorter than (about ⅔) the length of a conventional ironing board, which is about 4-5 feet long and about 1-2 feet wide. The pad assembly 10 is preferably shorter than a conventional, free-standing ironing board. As seen in FIG. 3, the width of the pad portion 13 is about the same as the width of the top of a conventional washing machine or clothes dryer 16. The pad portion 13 is preferably slightly longer than a conventional washing machine or clothes dryer top, so that the flexible pad portion 13 slightly hangs over the top of the support surface onto the opposite sides of the washing machine or clothes dryer, as seen in FIG. 3. The ends of the pad assembly 10 need not overlap the substantially horizontal support surface 15, though; the pad assembly can be laid out flat on a support surface such as a dining room table and used. Although the pad portion 13 can be a variety of sizes, in a preferred embodiment, it is between about two and about four feet, most preferably about three feet, in length, and between about one and about two feet, most preferably about 1.5 feet, in width.

Figure 8:
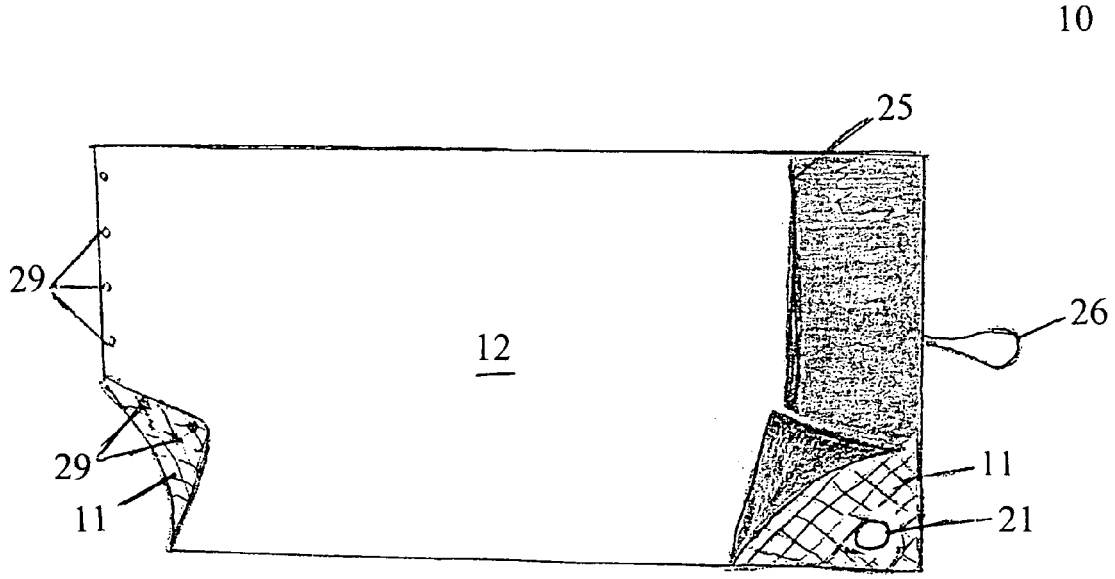
FIG. 8 is a perspective view of an ironing pad assembly according to the present invention, showing detachable fasteners and a pocket.

At least one magnet 21 is attached to or, preferably, enclosed in each of the four corner sections 17 of the pad portion 13, as seen in FIGS. 1 and 8. Magnets 21 suitable for use herein include small, individual magnets of any shape, magnetic strips, magnetic particles imbued in the fabric, or the like. Although any type of magnets may be employed herein, ceramic block magnets are preferred for their versatility and low cost. The magnets 21 may be glued onto the interior surface (the back) of the sturdier quilted layer 11 (see FIG. 1). The magnets 21 are preferably enclosed in the corner sections 17 of the pad portion 13 within, for example, a right angle seam 18 in each corner section 17 around the magnet 21, as illustrated in FIG. 1. The "right angle seam" is two seams that start at the same point and extend to the end of the pad, forming an approximate right angle. One option is to sew the right angle seams 18 on the interior surface of the first, quilted layer 11 before attaching the first, quilted layer 11 to the second, smooth layer 12 during manufacture of the pad assembly 10. An alternate option is to sew a right angle seams 18 through the pad portion 13 (both layers) in each corner 17 during manufacture of the pad assembly 10 as seen in FIG. 1. In the latter case, a small (e.g., 2 inch×2 inch) square of cotton or other material is optionally placed between the back of the magnet 21 and the preferred aluminized cotton second, smooth layer 12 to reduce friction and wear over time. The pad portion 13 preferably includes four individual magnets 21, with a surface of each magnet 21 adhered to the interior surface of the first, quilted layer 11.

The sides of the clothes dryer 16, or other support surface 23 are preferably ferromagnetic so as to attract the magnets 21 in the pad assembly 10. Herein, "ferromagnetic" means that the support surface is itself ferromagnetic or is coated with a ferromagnetic material so that it attracts the magnets 21 in the pad assembly. Because of the magnets 21, the pad assembly 10 stays in place even during back and forth movement of the iron during the ironing process. When it is on a ferromagnetic support surface, the "magnetic" pad assembly 10 does not have to be held with the user's left hand while the right hand moves the iron, or vice versa for a left handed user, because the pad assembly is unlikely to slide around. With the magnetic pad assembly, the user's left (or right) hand is free to manipulate the clothing item or other item being ironed.

The magnets 21 support the pad assembly 10 on any ferromagnetic or other substantially horizontal and planar (flat) support surface 15 while it is in use. Even after use, the magnets 21 are useful for hanging the folded or compacted pad assembly 10 on a ferromagnetic surface, even a substantially vertical planar surface 23 like the side of a washing machine or clothes dryer 16. For storage, the pad assembly 10 may be placed in its extended position on a substantially vertical surface 23 that is ferromagnetic. If desired, the pad assembly 10 may be folded in two and its corner magnets 21 placed on the ferromagnetic surface, such as the side of the clothes dryer 16, washing machine, etc., for storage. When it is time to iron, the pad assembly 10 can easily and conveniently be pulled off the side of the clothes dryer 16 and placed over the top of the dryer 16. Alternatively, the pad assembly 10 can be folded so that the two pairs of magnets 21 adhere to one another and hold the pad assembly in the folded position for storage.

As shown in the preferred embodiment of FIG. 3, the pad assembly 10 includes an iron rest 24 on which the iron 22 can be placed whenever the user wishes to pause during the ironing process, or after ironing is completed. The iron rest 24 frees up the entire pad portion 13 for use, since the iron 22 would otherwise be placed on a corner section of the pad assembly. Like the pad portion 13, the iron rest 24 is reversible; an iron 22 can be placed on either side of the iron rest 24. The iron rest 24 is preferably made of a double layer of the same material as the second, smooth layer 12 in order to provide a flat, stable surface for the iron 22. As seen in FIGS. 1 and 3, a long edge of the iron rest 24 is attached to one long side, or edge, 20 of the pad portion 13, preferably by sewing.

The pad assembly 10 can be used for any household task or other task that requires a compact, heat-resistant pad that is easy to move from place to place. For example, the pad assembly 10 can be placed under hot rollers, a hot plate, a curling iron, and/or a hair dryer for use as a hot pad to reduce the likelihood of damage to the countertop or other surface beneath the pad assembly 10. The curling iron or hair dryer, for example, can be placed on the iron rest 24, if desired. Also, the pad assembly 10 in its expanded position can be placed on a table under a tablecloth in lieu of trivets to absorb heat from warm plates placed on the table.

With continued attention to FIGS. 1 and 3, the pad assembly 10 includes a pocket 25 on the side of the pad portion 13 opposite the fourth side 19. The pocket 25 is formed by attaching three adjacent edges of a third, smaller, generally rectangular-shaped layer of material to three adjacent edges of the pad portion at one end of the pad assembly. The fourth edge 32 of the third pocket layer 25 remains unattached/open. The pocket 25 is preferably made of a nylon stretch material. If the pocket 25 is made of a different fabric, it preferably includes a piece of elastic or the like on its fourth, open edge 32 so the pocket contents are less likely to fall out. The pocket 25 preferably covers between about ¼ and about ⅕ of either layer 11, 12, as can be seen in FIG. 1. The magnet seams 18 are concealed by the pocket layer.

When the second, smooth layer 12 of the pad portion 13 is up (being used as the ironing surface) as seen in FIG. 3, the pocket 25 hangs off one side of clothes dryer 16 or other support surface. In this position, the pocket 25 is convenient for storing miscellaneous small items, such as safety pins or a spray bottle. Since the pocket 25 is draped over an upper portion of one side of the clothes dryer 16, storing items in the pocket 25 does not reduce the amount of pad surface available for ironing.

A second pocket (not shown) may be included on the fourth, opposite side 19 of the pad portion, if desired. When it is on the same layer as the first pocket, the second pocket hangs over an upper portion of the opposite side of the dryer 16 and can be used for the same purpose as the first pocket 25. The pad assembly 10 may include one or two pockets 25 on the opposite, quilted side 11 instead of or in addition to the one or two pockets on the smooth layer 12 side.

As shown in FIGS. 1, 4, and 5, a preferred pad assembly 10 includes at least one loop 26 attached to a shorter side of the pad portion 13. Opposite ends of the loop 26, which is preferably made of a nylon material, are preferably sewn into the corresponding pad seam next to one another. The loop 26 is preferably on the same side of the pad assembly 10 as the pocket 25. If desired, the electrical cord of the iron can be passed through the loop. The loop 26 guides the iron cord, keeping it off the pad portion 13 and to the side of the clothes dryer or other substantially horizontal support surface 15. The loop or loops can also be used to hang the pad assembly when it is not in use.

Figure 6:
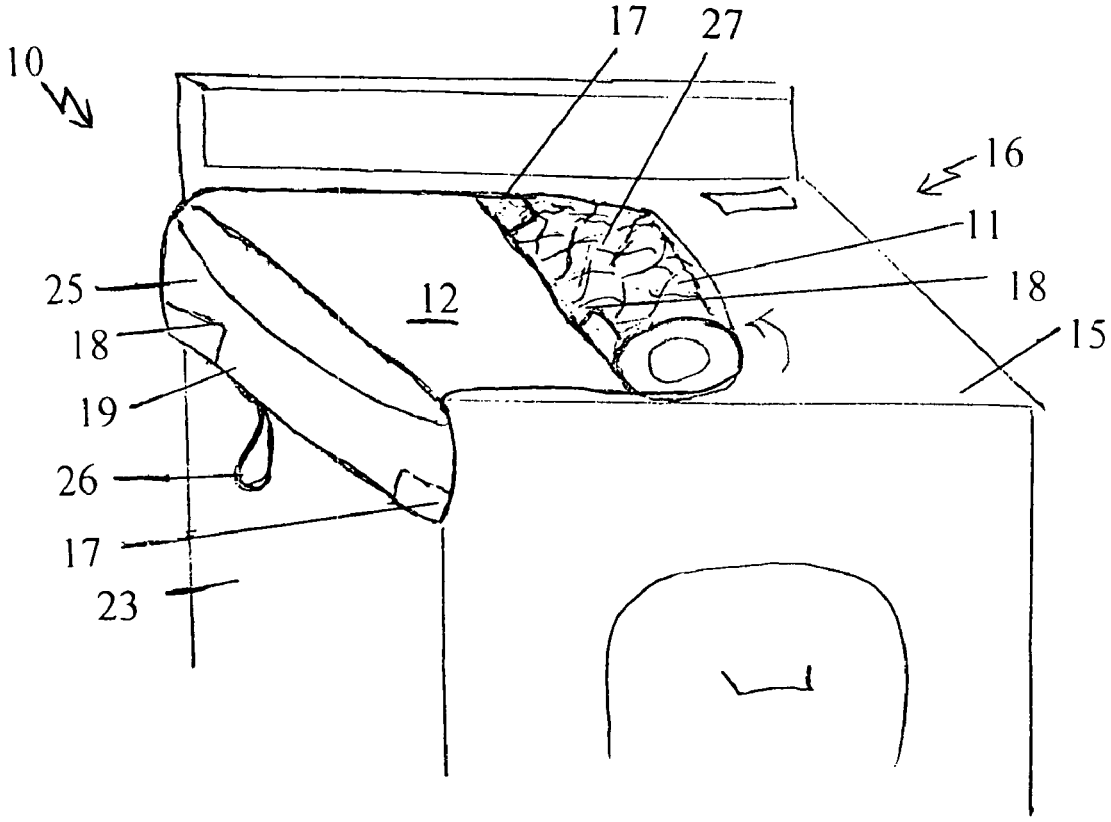
FIG. 6 is a perspective view of an ironing pad assembly according to the present invention, shown in a partially bundled condition.

When the user is finished ironing, he or she rolls or otherwise bundles the opposite side of the pad assembly 10 (on its short axis) toward the pocket 25 of the pad assembly 10, as shown in FIG. 6. If the pad assembly 10 includes an iron rest 24, the iron rest is folded onto the topmost layer prior to bundling. The user then pulls open the open, stretchy edge 32 of the pocket 25 and tucks the bundled portion 27 of the pad assembly 10 into the pocket 25. This is the compact, bundled position of the pad assembly 10, which is convenient for storage or transport, as depicted in FIGS. 4 and 5.

The user can then hang the loop 26 of the compacted pad assembly on a hook 28 on a wall of the laundry room, or another substantially vertical planar surface 23. The hook 28 itself may include a magnetic backing and be removable so that it can be placed on a substantially vertical planar surface 23 that is ferromagnetic. Alternatively, the pad assembly in its compact position can be hung from a substantially vertical surface 23 that is ferromagnetic, such as a side of a clothes dryer 16, etc. by simply placing the compact pad assembly against the substantially vertical surface 23. The magnets 21 attach to the ferromagnetic surface 23. The compact pad assembly is easily removed from the substantially vertical surface 23 by simply pulling it away from the substantially vertical surface 23. It can then easily be unfurled for use.

In FIG. 7, the pad assembly 10 has two loops 26 for hanging the pad assembly from a hanger, and for guiding the iron cord. In the latter case, the iron cord is passed through either loop 26 prior to using the iron. Alternatively, the pad assembly 10 can be hung from hooks on a wall using the loops for storage in a laundry room, for example.

As illustrated in FIG. 8, an alternative carry bag embodiment herein includes a fastener mechanism 29 for detachably attaching a short edge of the first, quilted layer 11 to the corresponding edge of the second, smooth layer 12. The pad assembly 10 can itself be used as a carry bag when it is not being used for ironing. To manufacture this pad assembly 10, three inside seams are machine stitched along three adjacent edges of the pad portion 13 while the pad portion 13 is inside out. The pad portion 13 is then turned out and the detachable fastener mechanism 29, preferably magnetic or standard snap fasteners, is attached to the fourth, short edge 19 of the pad portion (see FIG. 8). Alternatively, the fastener mechanism may include a pull string tie (not shown) within a hem around a fourth edge 19 of the pad portion. The fasteners 29 are unfastened to insert an article, such as clean clothing to iron, into the pad assembly carry bag. Once the article is in the pad assembly carry bag, the fasteners are fastened and the bag is ready for transport or storage. The article must be removed in order to use the pad assembly 10 for ironing. Magnets 21 employed herein may have any suitable shape, and are preferably rectangular as shown in FIG. 1, or round as shown in FIG. 8.

Figure 9:
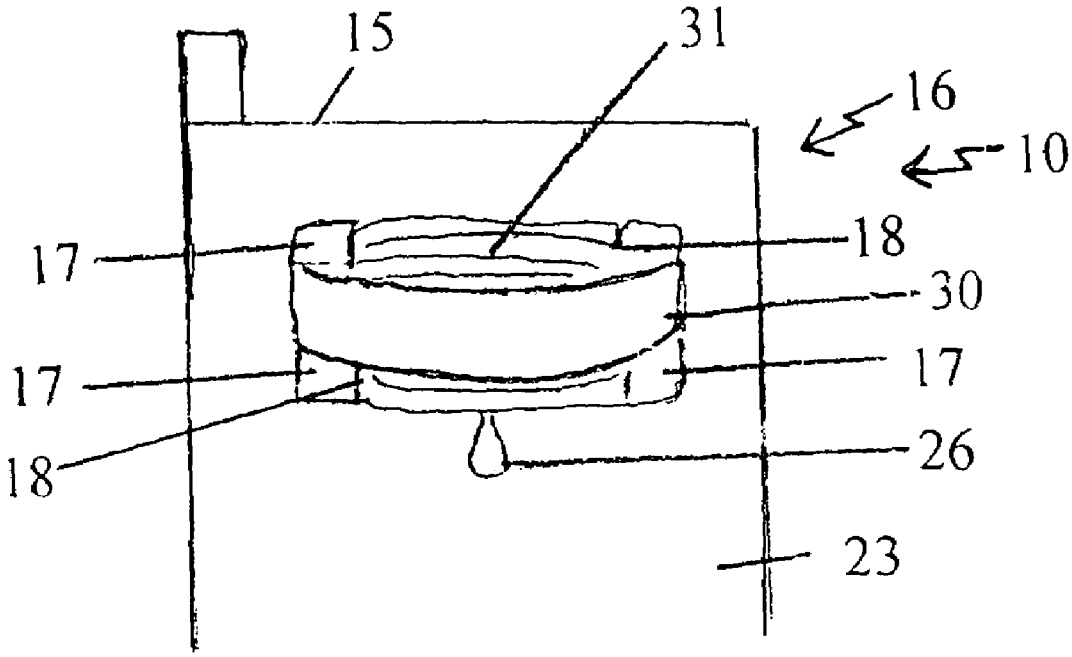
FIG. 9 is a perspective view of an ironing pad assembly according to the present invention, shown bundled in a band and magnetically attached to a side of a clothes dryer.

Referring to FIGS. 7 and 9, the pad assembly 10 optionally comprises a stretchable band 30 instead of or in addition to a pocket 25. The generally rectangular-shaped band 25 is attached at its opposite ends to two opposite sides of the pad portion 13 (see FIG. 7). The opposite long sides of the band 30 remain open. The ends of the band 30 are preferably sewn into the seams on an end section of the pad portion. The band 30 is preferably made of a nylon stretch material. The band 30 preferably covers between about ¼ and about ⅕ of either layer 11, 12, as can be seen in FIG. 7. This is also the amount of the pad assembly that overlaps each side of the support surface when the pad assembly 10 is used on a clothes dryer 16, washing machine, or the like. A pad assembly 10 may include one or more pockets 25 and/or bands 30 on either or both sides/layers of the pad portion 13.

When the user is finished ironing, he or she roughly pleats a midsection of the pad portion 13 into a number of accordion pleats along the pad's short axis. The user holds the accordion pleats on top of one another (the pleated portion 31) with one hand while lifting the stretch band 30 with the other hand and tucking the accordion pleated portion 31 under the band 30. Referring to FIG. 9, this compact position of the pad assembly 10 is convenient for storage or transport. The stretch nylon allows the bulk of the pad to be held in place. The band 30 can be used for other purposes, such as supporting a spray bottle, when it is not in use for this purpose.

The loop 26 of the compacted pad assembly can be hung on a hook 28 on a wall of the laundry room or another substantially vertical planar surface 23. The hook 28 itself may include a magnetic backing and be removable so that it can be placed on a substantially vertical planar surface 23 that is ferromagnetic prior to hanging the lightweight compact pad assembly on the hook. Alternatively, the pad assembly in its compact position can be hung from a substantially vertical surface 23 that is ferromagnetic, such as a side of a clothes dryer 16, etc. by simply placing the compact pad assembly against the substantially vertical surface 23 (see FIG. 9). The magnets 21 in the corner sections 17 are accessible for contact with the ferromagnetic substantially horizontal or vertical support surface 15, 23. The compact pad assembly is easily removed from the substantially vertical support surface 23 by simply pulling it away from the support surface 23. The compact pad assembly 10 can easily be unfurled for use at a later time.

From the foregoing it can be realized that the described device of the present invention may be easily and conveniently utilized as a reversible ironing pad assembly. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A reversible ironing pad assembly, comprising:

(a) a generally rectangular-shaped, flexible pad portion comprising a first, quilted, heat resistant layer; and a second, opposite, generally smooth, heat resistant layer on an opposite side of the pad portion; and (b) at least one magnet in each corner section of the pad portion;

wherein the first or second layer comprises a metal; and wherein the pad assembly comprises an expanded, open position for use and a compact, bundled position for transport or storage, and in the expanded position, the pad portion is reversible for use on either side.

2. The pad assembly according to claim 1, wherein the quilted layer comprises a fabric backing on its interior surface.

3. The pad assembly according to claim 2, wherein the pad assembly does not comprise any additional, separate, interior layers.

4. The pad assembly according to claim 2, wherein the metal is aluminum.

5. The pad assembly according to claim 1, further comprising a detachable fastener mechanism on one, openable side of the pad portion; wherein the pad assembly is itself usable as a carry bag.

6. The pad assembly according to claim 1, wherein the at least one magnet is a ceramic block magnet, and the pad portion comprises four of the at least one magnets.

7. The pad assembly according to claim 2, wherein the first and second layers are substantially the same length and width as one another, and no adhesive is used to bind the layers.

8. The pad assembly according to claim 1, further comprising a pocket formed by attaching three adjacent edges of a third, generally rectangular-shaped pocket layer to three adjacent edges of the second, smooth layer or the first, quilted layer, a fourth edge of the third pocket layer remaining unattached and open.

9. The pad assembly according to claim 1, further comprising at least one loop comprising opposite ends attached to a side of the pad portion.

10. The pad assembly according to claim 1, wherein the first and second layers are both an aluminized fabric comprising cotton.

11. The pad assembly according to claim 10, wherein the first, quilted layer comprises an aluminized cotton fabric on its exterior surface and a cotton backing on its interior surface, the quilt layer interior backing being quilted onto the aluminized cotton fabric exterior.

12. The pad assembly according to claim 10, wherein an exterior surface of the first, quilted layer is useable for ironing sturdy fabrics, and an exterior surface of the second, smooth layer is useable for ironing delicate fabrics.

13. The pad assembly according to claim 1, further comprising a stretchable band attached at its opposite ends to two opposite sides of the pad portion.

14. The pad assembly according to claim 1, wherein each of the at least one magnets is enclosed in a corner section of the pad portion.

15. The pad assembly according to claim 6, wherein each of the at least one magnets is enclosed in a corner section of the pad portion within a right angle seam.

16. The pad assembly according to claim 10, further comprising an iron rest attached to a long edge of the pad portion.

17. The pad assembly according to claim 10, wherein the pad assembly is also usable as a hot pad.

18. The pad assembly according to claim 1, further comprising at least one detachable fastener attached to an openable fourth edge of the pad portion; wherein the first and second layers are stitched to one another along the other three adjacent edges of their periphery.

19. The pad assembly according to claim 13, wherein the pad assembly in its compact position comprises an accordion pleated midsection pad portion between the band and the first or second layer.

20. The pad assembly according to claim 19, wherein the pad assembly in its compact position comprises a bundled portion of the pad assembly within the pocket.

* * * * *